US005639092A

United States Patent [19]

Macaisa

[11] Patent Number: 5,639,092

[45] Date of Patent: Jun. 17, 1997

[54] METHOD OF PLAYING A CASINO TABLE GAME HAVING MULTIPLE CASINO GAMES

[76] Inventor: Renato L. Macaisa, 331 Wayne St., Jersey City, N.J. 07302

[21] Appl. No.: 693,445

[22] Filed: Aug. 7, 1996

[51] Int. Cl.[6] ..... A63F 1/00

[52] U.S. Cl. ..... 273/292; 273/274

[58] Field of Search ..... 273/292, 274, 273/309

[56] References Cited

U.S. PATENT DOCUMENTS 5,013,049 5/1991 Tomaszewski ..... 273/292

5,265,882 11/1993 Malek ..... 273/292

5,377,993 1/1995 Josephs ..... 273/292

*Primary Examiner*—Benjamin H. Layno

*Attorney, Agent, or Firm*—Ezra Sutton

[57] ABSTRACT

The present invention provides a method of playing a casino game using a game board having a dealer position, a plurality of player positions, each player position having a first betting position for betting blackjack, a second betting position for betting roulette, a third betting position for betting baccarat, a fourth betting position for betting poker, and a fifth betting position for betting jackpot.

9 Claims, 1 Drawing Sheet

METHOD OF PLAYING A CASINO TABLE GAME HAVING MULTIPLE CASINO GAMES

FIELD OF THE INVENTION

The present invention relates to a casino game that provides players with a convenient one-stop, table game to play Blackjack, Roulette, Baccarat, Poker, Jackpot, or any combination of these games.

BACKGROUND OF THE INVENTION

Casinos typically have many different table games, including tables for playing Blackjack, Roulette, Baccarat, Poker or a Jackpot game. However, the player can only play one of these games at any given table. Present table games do not provide multiple games at the same table.

Accordingly, it is an object of the present invention to provide a table game which allows a player to play different casino games at the same table.

It is a further object of the present invention to provide a table game where a player can play any one or all of the following casino games at the same time: Blackjack, Roulette Baccarat, Poker, or a Jackpot game.

SUMMARY OF THE INVENTION

The present invention provides a method of playing a casino game using a game board having a dealer position, a plurality of player positions, each player position having a first betting position for betting blackjack, a second betting position for betting roulette, a third betting position for betting baccarat, a fourth betting position for betting poker, and a fifth betting position for betting jackpot. The game includes the following steps:

a) each player at each makes one or more bets on the first through fifth betting positions to indicate the games being bet;

b) the dealer dealing two cards to each player who placed one or more bets and to himself;

c) if any player has a red and black card on the first two cards, the dealer wins and taking that player's bet placed on the second betting position for betting roulette;

d) if any player has two red cards or two black cards on the first two cards, that player wins, and the dealer pays that player according to a preset wagering scale for the bet placed on that player's second betting position for betting roulette;

e) the dealer asking each player if they want optional third, fourth and fifth cards;

f) the dealer dealing a third, fourth, and fifth card to each remaining player who exercises the option;

g) if any player has over 21 without three of a kind, the dealer wins and takes that player's bet placed on the first betting position for betting blackjack, the player's bet placed on the fourth betting position for betting poker, and the player's bet placed on the fifth betting position for betting jackpot;

h) if any player has a pair of tens or higher and beats the dealer's hand, the dealer pays that player according to a preset waging scale for betting on the blackjack position only;

i) if any player has less than a pair of tens and beats the dealer's hand, the dealer pays that player according to a preset wagering scale for betting on the blackjack position only;

j) if any player has an identical tie hand with the dealer, the dealer returning to each said player any bets made on the blackjack position only; and k) if the dealer's cards are over 21, the dealer paying each player according to the bets placed on the blackjack position only.

BRIEF DESCRIPTION OF DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
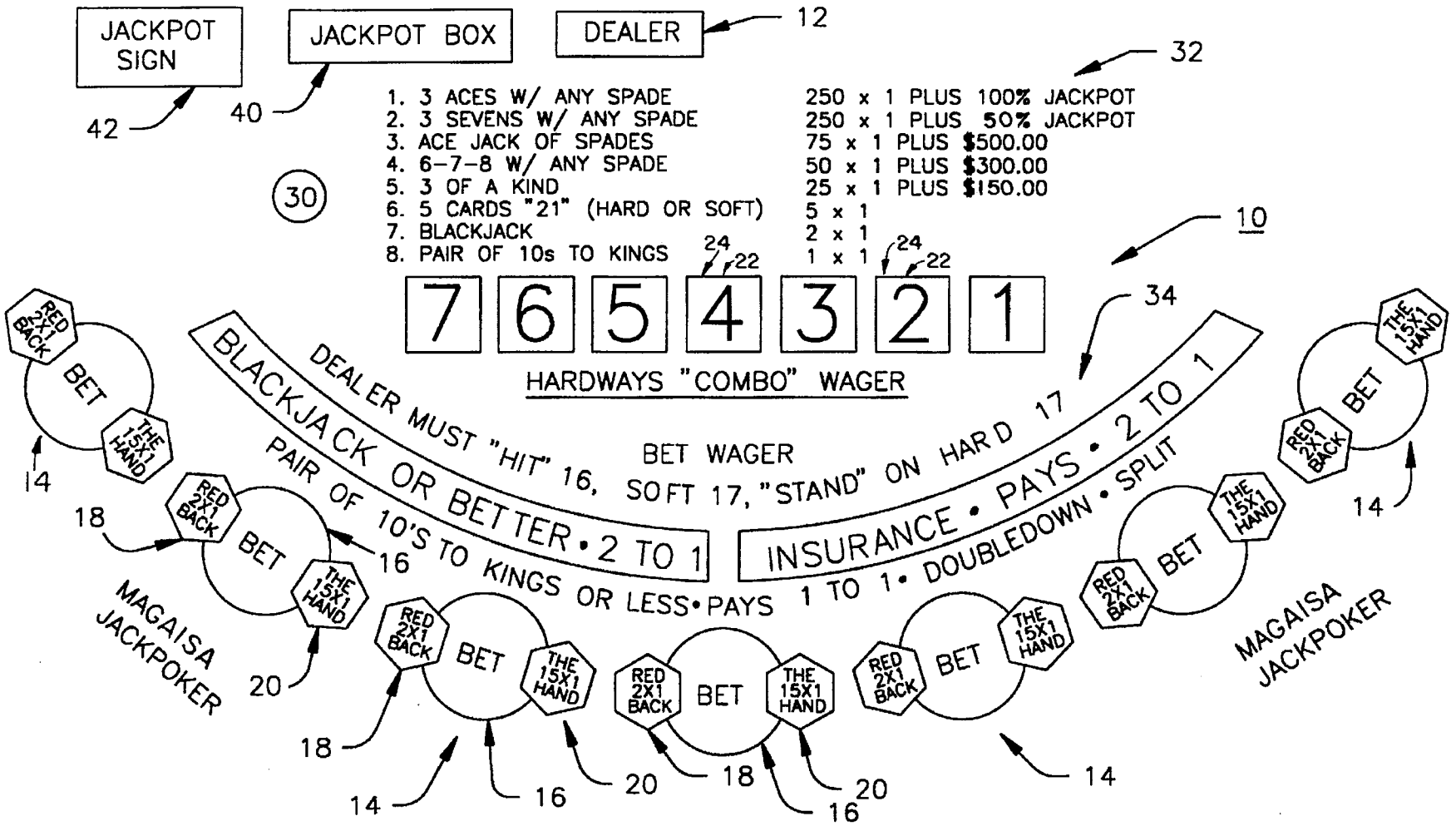
FIG. 1 is a diagram showing the table game of the present invention.

FIG. 1 shows a table game 10 employing the preferred embodiment of the present invention. There is a dealer position 12 and a plurality of player positions 14. Each player position 14 has a first betting position 16 for betting blackjack, a second betting position 18 for betting roulette, a third betting position 20 for betting baccarat, a fourth betting position 22 for betting poker, and a fifth betting position 24 for betting a jackpot game. Although there can be any number of player positions 14, the present invention shows 7 player positions. Also, for each player, the fourth and fifth betting positions 22 and 24 are designated by the numbers 1 to 7 where players 1 to 7 place their respective bets. As explained herein, each player places their bet for poker and jackpot on one of the designated positions 1 to 7. For example, if player 3 wishes to bet on both poker and jackpot, then player 3 places 2 bets or chips on position "3", the lower bet for poker and the upper bet for jackpot. In addition, the table top 30 sets forth the playing rules at 32 and 34.

The method of playing the game is as follows. Each player at each player position 14 makes one or more bets at his or her first through fifth betting positions to indicate which games are being played. For example, if player 3 wishes to bet on all five games at the same time, player 3 places bets or chips on betting positions 16, 18, 20, 22 and 24. For example, a five dollar chip may be placed on each of these positions for a total of $25.00, with the "3" position at 22 and 24 having two five dollar chips stacked on top of each other.

Next, the dealer deals two cards to each player (face up) who placed one or more bets and the dealer also deals two cards to himself, one face up and one face down, as in conventional blackjack. At this point in the game if any player has 12 on the first two cards, the dealer wins and takes that player's bet placed on the second betting position 18 for betting roulette. Also, if any player has a red and black card on the first two cards, the dealer wins and takes that player's bet placed on the second betting position 18 for betting roulette. Also if any player has two red cards or two black cards on the first two cards, that player wins, and the dealer pays that player according to a preset wagering scale for the bet placed on that player's second betting position 18 for betting roulette. In this example, position 18 states that the preset waging scale is 2 to 1, so the player receives $10.00 for his or her $5.00 wager.

At this point in the game, the third, fourth or fifth cards are optional cards so that the dealer then asks each player if they want the optional third card. If a player elects not to take a third card from the dealer, then that player cannot elect to take a fourth or fifth card when they are dealt. The dealer then deals a third card to each player who exercises the option, but does not deal a third card to himself at this point. If any player has over 21 without having three of a kind, the dealer wins and takes that player's bet placed on the first betting position 16 for betting blackjack, and the dealer also takes that player's bet placed on the fourth and fifth betting positions 22 and 24 for betting poker and the jackpot game.

The dealer then asks each player who has taken a third card if they want the optional fourth card. If a player elects not to take a fourth card from the dealer, then that player cannot elect to take a fifth card when they are dealt. The dealer then deals a fourth card to each player who exercises the option, but does not deal a fourth card to himself at this point. If any player has over 21 without having three of a kind, the dealer wins and takes that player's bet placed on the first betting position 16 for betting blackjack, and the dealer also takes that player's bet placed on the fourth and fifth betting positions 22 and 24 for betting poker and the jackpot game.

The dealer then asks each player who has taken a fourth card if they want the optional fifth card. The dealer then deals a fifth card to each player who exercises the option, but does not deal a fifth card to himself at this point. If any player has over 21 without having three of a kind, the dealer wins and takes that player's bet placed on the first betting position 16 for betting blackjack, and the dealer also takes that player's bet placed on the fourth and fifth betting positions 22 and 24 for betting poker and the jackpot game.

At this point in the game, after each player has received the optional fifth card, the dealer then turns his second card face up for everyone to see to determine if the dealer gets any additional cards, as in conventional blackjack. As stated at location 34 on the table, if the dealer has 16 or less or a "soft" 17, he must keep taking additional cards until he has a "hard" 17 or higher. If the dealer has a "hard" 17 or higher, the dealer gets no additional cards.

At this point in the game, if any player has 21 or better and beats the dealer's hand, the dealer pays that player according to the preset wagering scale shown at location 32 for the bet placed on that player's first betting position 16 for betting blackjack. If any player has a pair of tens or higher and beats the dealer's hand, the dealer pays that player according to a preset waging scale shown at location 32 for betting on the blackjack position 16 only. If any player has less than a pair of tens and beats the dealer's hand, the dealer pays that player according to a preset wagering scale shown a location 32 for betting on the blackjack position 16 only. If any player has an identical tie hand with the dealer, the dealer returns to that player any bets made on the blackjack position 16 only. If the dealer's cards are over 21, the dealer pays each player according to the bets placed on the blackjack position 16 only. If any player has any of the preset poker rankings (1 to 8), as shown in FIG. 1 the dealer pays that player according to the player's bet on the fourth betting position 22 for betting poker. If any player has any of the preset poker rankings (1 to 5), as shown in FIG. 1 the dealer pays that player according to that player's bet on the fifth betting position 24 for betting the jackpot game and according to the preset wagering scale shown at location 32.

In the preferred embodiment of the game, a player must place a bet on the blackjack position 16 in order to be able to place a bet on any of the other betting positions 18, 20, 22 and 24. Also, the player must place a bet on the poker position 22 in order to be able to place a bet on the jackpot position 24.

In the preferred embodiment of the game, if any player has an identical tie hand with the dealer, the dealer pays that player according to that player's bet on the third betting position 20 for betting baccarat, wherein the dealer and player's hands have the same card count and the same rank. Also, if a player splits the first two cards dealt to that player, then it is a push with the dealer, and the dealer must return to that player his bets placed on the third and fourth betting positions 20 and 22 for baccarat and poker, and the player continues to play his two hands and must place a second bet on the blackjack position.

In the preferred embodiment of the game, the game has a jackpot box 40 and a jackpot sign 42. If any player wins their bet on poker, the dealer takes preset percentage of that player's winnings, such as 5%, and deposits the percentage in jackpot box 40. If any player loses their bet on poker, the dealer takes a preset percentage of that player's bet on poker, such as 5%, and deposits the percentage in the jackpot box 40. The casino then collects the deposits in jackpot box 40 and sets the jackpot sign 42 to indicate the amount of money in jackpot box 40.

In a second embodiment of the game, any player may place a jackpot bet (i.e., $1.00) on top of his bet on the fourth betting position 22 for betting poker, and if that player loses, the dealer collects the jackpot bet after each game and deposits it in jackpot box 40.

In a third embodiment of the game, any player may place a bet on fourth betting position 22 for betting poker, and it is automatically counted as a bet on the fifth betting position 24 for betting the jackpot game.

As in conventional blackjack, if the dealer is dealt an ace, each player has the option of placing an "insurance" bet on his first betting position 16 for betting blackjack. Also, if a player receives two cards of the same rank, each player has the option of splitting the hand and doubling his bet on blackjack to play two hands. Further, if a player receives two cards, each player has the option of doubling his bet on blackjack, as in conventional blackjack.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method of playing a game using at least one conventional deck of cards, a game board having a dealer position, a plurality of player positions, each player position having a first betting position for betting blackjack, a second betting position for betting roulette, a third betting position for betting baccarat, a fourth betting position for betting poker, and a fifth betting position for betting jackpot, comprising the steps of:

a) each player at each of said player positions making one or more bets at said first through fifth betting positions to indicate the games being bet;

b) the dealer at said dealer position dealing two cards to each player who placed one or more bets and to himself, the dealer having a first card face up, and a second card face down;

c) if any player having placed a bet on the second betting position and has a total of 12 on the first two cards, the dealer wins and taking that player's bet placed on the second betting position for betting roulette;

d) if any player having placed a bet on the second betting position and has a red and black card on the first two cards, the dealer wins and taking that player's bet placed on the second betting position for betting roulette;

e) if any player having placed a bet on the second betting position and has two red cards or two black cards on the first two cards, that player wins, and the dealer pays that player according to a preset wagering scale for the bet placed on that player's second betting position for betting roulette;

f) the dealer asking each player if they want an optional third card;

g) the dealer at said dealer position dealing a third card to each remaining player who exercises the option;

h) if any player having placed a bet on the first, fourth, and/or fifth betting positions and has a total of over 21 without three of a kind, the dealer wins, and taking that player's bet placed on the first betting position for betting blackjack, the player's bet placed on the fourth betting position for betting poker, and the player's bet placed on the fifth betting position for betting jackpot;

i) the dealer asking each player that still has bets placed on the first, fourth, and/or fifth betting positions if they want an optional fourth card;

j) the dealer at said dealer position dealing a fourth card to each remaining player who exercises the option;

k) if any player having placed a bet on the first, fourth, and/or fifth betting positions and has a total of over 21 without three of a kind, the dealer wins and taking that player's bet placed on the first betting position for betting blackjack, the player's bet placed on the fourth betting position for betting poker, and the player's bet placed on the fifth betting position for betting jackpot;

l) the dealer asking each player that still has bets placed on the first, fourth, and/or fifth betting positions if they want an optional fifth card;

m) the dealer at said dealer position dealing a fifth card to each remaining player who exercises the option;

n) if any player having placed a bet on the first, fourth, and/or fifth betting positions and has a total of over 21 without three of a kind, the dealer wins and taking that player's bet placed on the first betting position for betting blackjack, the player's bet placed on the fourth betting position for betting poker, and the player's bet placed on the fifth betting position for betting jackpot;

o) after each player receives the optional fifth card, the dealer then turns over his second card to determine if the dealer gets any additional cards;

p) if any player still has a bet placed on the first betting position and has a total of 21 or better and beats the dealer's hand, the dealer paying each said player according to a preset wagering scale for the bet placed on that player's first betting position for betting blackjack;

q) if any player still has a bet placed on the first betting position and has a pair of tens or higher and beats the dealer's hand, the dealer paying each said player according to a preset wagering scale for betting on the blackjack position only;

r) if any player still has a bet placed on the first betting position and has less than a pair of tens and beats the dealer's hand, the dealer paying each said player according to a preset wagering scale for betting on the blackjack position only;

s) if any player still has a bet placed on the first betting position and has an identical tie hand with said dealer, the dealer returning to each said player any bets made on the blackjack position only;

t) if the dealer's cards are over 21, the dealer paying each player according to the bets placed on the blackjack position only;

u) if any player has any preset poker rankings, the dealer paying that player according to that player's bet on the fourth betting position for betting poker; and v) if any player has any preset poker rankings, the dealer paying that player according to that player's bet on the fifth betting position for betting the jackpot and according to the preset wagering scale.

2. A method of playing a game in accordance with claim 1, wherein said game is a table game and said fourth and fifth betting positions are in the same location, and further including the steps of:

a) the player betting blackjack in order to place a bet on any of the second to the fifth betting positions; and b) the player betting poker in the fourth betting position in order to place a bet on the jackpot position in the fifth betting position.

3. A method of playing a game in accordance with claim 1, further including the step of:

a) if any player has an identical tie hand with the dealer, the dealer paying that player according to that player's bet on the third betting position for betting baccarat, wherein the dealer and player's hands have the same card count and the same rank.

4. A method of playing a game in accordance with claim 1, further including the step of:

a) if a player splits the two cards dealt to that player, then it is a push with the dealer, and the dealer returning to that player his bets placed on the third and fourth betting positions for baccarat and poker, and the player continuing to play his two hands and must place a second bet on the blackjack position.

5. A method of playing a game in accordance with claim 1, wherein said game has a jackpot box and a jackpot sign, and further including the steps of:

a) if any player wins their bet on poker, the dealer taking a preset percentage of that player's winnings and depositing the percentage in said jackpot box;

b) if any player loses their bet on poker, the dealer takes a preset percentage of that player's bet on poker and deposits the percentage in said jackpot box;

c) collecting the deposits in said jackpot box; and d) setting the jackpot sign to indicate the amount of money in said jackpot box.

6. A method of playing a game in accordance with claim 1, wherein said game has a jackpot box, and further including the step of:

a) a player placing a jackpot bet on top of his bet on the fourth betting position for betting poker, and if that player loses, the dealer collecting the jackpot bet after each game and depositing it in said jackpot box.

7. A method of playing a game in accordance with claim 1, and further including the step of:

a) a player placing a bet on said fourth betting position for betting poker, and automatically counting it as a bet on said fifth betting position for betting jackpot.

8. A method of playing a game in accordance with claim 1, further including the steps of:

a) if the dealer is dealt an ace, each player has the option of placing an "insurance" bet on his first betting position for betting blackjack, as in conventional blackjack;

b) if a player receives two cards of the same rank, each player has the option of splitting the hand and doubling his bet on blackjack to play two hands, as in conventional blackjack; and c) if a player receives two cards, each player has the option of doubling his bet on blackjack, as in conventional blackjack.

9. A method of playing a game using at least one conventional deck of cards, a game board having a dealer position, a plurality of player positions, each player position having a first betting position for betting blackjack, a second betting position for betting roulette, a third betting position for betting baccarat, a fourth betting position for betting poker, and a fifth betting position for betting jackpot, comprising the steps of:

a) each player at each of said player positions making one or more bets at said first through fifth betting positions to indicate the games being bet;

b) the dealer at said dealer position dealing two cards to each player who placed one or more bets and to himself, the dealer having first card face up, and a second card face down;

c) if any player having placed a bet on the second betting position and has a red and black card on the first two cards, the dealer wins and taking that player's bet placed on the second betting position for betting roulette;

d) if any player has two red cards or two black cards on the first two cards, that player wins, and the dealer pays that player according to a preset wagering scale for the bet placed on that player's second betting position for betting roulette;

e) the dealer asking each player if they want an optional third card;

f) the dealer at said dealer position dealing a third card to each remaining player who exercises the option;

g) if any player having placed a bet on the first, fourth, and/or fifth betting positions and has a total of over 21 without three of a kind, the dealer wins and taking that player's bet placed on the first betting position for betting blackjack, the player's bet placed on the fourth betting position for betting poker, and the player's bet placed on the fifth betting position for betting jackpot;

h) the dealer asking each player that still has bets placed on the first, fourth, and/or fifth betting positions if they want an optional fourth card;

i) the dealer at said dealer position dealing a fourth card to each remaining player who exercises the option;

j) if any player having placed a bet on the first, fourth, and/or fifth betting positions and has a total of over 21 without three of a kind, the dealer wins and taking that player's bet placed on the first betting position for betting blackjack, the player's bet placed on the fourth betting position for betting poker, and the player's bet placed on the fifth betting position for betting jackpot;

k) the dealer asking each player that still has bets placed on the first, fourth, and/or fifth betting positions if they want an optional fifth card;

l) the dealer at said dealer position dealing a fifth card to each remaining player who exercises the option;

m) if any player having placed a bet on the first, fourth, and/or fifth betting positions and has a total of over 21 without three of a kind, the dealer wins and taking that player's bet placed on the first betting position for betting blackjack, the player's bet placed on the fourth betting position for betting poker, and the player's bet placed on the fifth betting position for betting jackpot;

n) after each player receives the optional fifth card, the dealer then turns over his second card to determine if the dealer gets any additional cards;

o) if any player still has a bet placed on the first betting position and has a total of 21 or better and beats the dealer's hand, the dealer paying each said player according to a preset wagering scale for the bet placed on that player's first betting position for betting blackjack;

p) if any player still has a bet placed on the first betting position and has a pair of tens or higher and beats the dealer's hand, the dealer paying each said player according to a preset wagering scale for betting on the blackjack position only;

q) if any player still has a bet placed on the first betting position and has less than a pair of tens and beats the dealer's hand, the dealer paying each said player according to a preset wagering scale for betting on the blackjack position only;

r) if any player still has a bet placed on the first betting position and has an identical tie hand with said dealer, the dealer returning to each said player any bets made on the blackjack position only; and s) if the dealer's cards are over 21, the dealer paying each player according to the bets placed on the blackjack position only.

* * * * *